US005954213A

United States Patent [19]

Gerhart et al.

[11] Patent Number: 5,954,213

[45] Date of Patent: Sep. 21, 1999

[54] DUAL CONTAINER AND INDIVIDUAL CHAMBER THEREFOR

[75] Inventors: Mark Douglas Gerhart; William Kevin Collis, both of Westminster, Md.

[73] Assignee: Lever Brothers Company, New York, N.Y.

[21] Appl. No.: 08/773,568

[22] Filed: Dec. 27, 1996

[51] Int. Cl.[6] ..... B65D 21/028; B65D 1/02

[52] U.S. Cl. ..... 215/10; 215/6; 206/514; 220/23.4; 220/23.83

[58] Field of Search ..... 215/6, 10; 206/514; 220/23.83, 23.4

[56] References Cited

U.S. PATENT DOCUMENTS

| | | | |
|---|---|---|---|
| D. 353,326 | 12/1994 | Abfier et al. | D9/341 |
| 3,225,951 | 12/1965 | Poston | 215/6 |
| 3,705,661 | 12/1972 | Davis | 215/6 |
| 3,933,268 | 1/1976 | Buske | 220/23.4 |
| 3,994,408 | 11/1976 | Belitzky | 215/10 |
| 4,003,491 | 1/1977 | Wells et al. | 215/10 X |
| 4,125,207 | 11/1978 | Ernst et al. | 215/10 X |
| 4,165,812 | 8/1979 | Jennison | 215/10 |
| 4,196,808 | 4/1980 | Pardo | 206/432 |
| 4,573,595 | 3/1986 | Mednis | 215/10 |
| 4,640,423 | 2/1987 | Mednis | 215/10 |
| 4,656,840 | 4/1987 | Loofbourrow et al. | 215/10 X |
| 4,673,094 | 6/1987 | Mednis | 215/10 |
| 5,007,551 | 4/1991 | Baroi | 215/10 X |
| 5,064,100 | 11/1991 | Mural | 215/10 X |
| 5,135,823 | 8/1992 | Eales | 215/6 X |
| 5,137,178 | 8/1992 | Stokes et al. | 222/94 |
| 5,152,432 | 10/1992 | De Laforcade | 222/145 |
| 5,158,191 | 10/1992 | Douglas et al. | 215/10 |
| 5,158,209 | 10/1992 | Reil et al. | 215/6 X |
| 5,289,950 | 3/1994 | Gentile | 222/142.3 |
| 5,316,159 | 5/1994 | Douglas et al. | 215/10 |
| 5,356,040 | 10/1994 | Reggiani | 220/23.83 |
| 5,386,928 | 2/1995 | Blette | 222/94 |
| 5,392,947 | 2/1995 | Gentile | 220/665 |

*Primary Examiner*—Sue A. Weaver
*Attorney, Agent, or Firm*—Gerard J. McGowan, Jr.

[57] ABSTRACT

A dual bottle is formed by two separable interlocked chambers. The chambers preferably each contain different ingredients and have adjacent product exit apertures so that after leaving the chambers the separate product streams can mix. Preferably the chambers are identical, which simplifies manufacture.

10 Claims, 5 Drawing Sheets

DUAL CONTAINER AND INDIVIDUAL CHAMBER THEREFOR

BACKGROUND OF THE INVENTION

In the dispensing of modern consumer products, it is sometimes desirable to keep one or more of the components separate until just before dispensing them in the final product. For example, it may be necessary to keep bleach and enzyme ingredients separate prior to dispensing the product to prevent undesirable, premature reaction of the components. Other examples where it may be desirable to keep ingredients separate in consumer products include surfactant and conditioner ingredients in shampoos and surfactant and moisturizer ingredients in shower gels.

While dual containers are desirable, it is also important that their fabrication be as simple and economical as possible. This objective is furthered if, for example, the dual compartments are identical.

Numerous dual chambered or multiple bottle packages are known in the art.

Gentile, U.S. Pat. No. 5,289,950 discloses a package for dispensing at least two liquid components simultaneously. The package comprises a container having at least two discrete compartments, each with an upper outlet end. A closure system for the container includes a crown portion having a peripheral skirt portion depending downwardly. At least two pouring spouts extend upwardly from the crown. Each pouring spout is provided with a through opening which extends from the upper end of the spout into a compartment. Separate storage compartments 8, 10 are provided. The two compartment container can either be formed of two entirely separate compartments which are held together by a closure system or can be formed by a dividing wall in the container. The closure system engages the outer surface of the container in a fluid tight manner. A conventional groove and bead snap fit engagement, which can be substituted with known equivalent engagements or seals, may be used.

Blette, U.S. Pat. No. 5,386,928 discloses a system for dispensing materials made of two components including a side by side pair of collapsible tubes that fit within a barrel of a pressurized air applicator. When air is admitted into the barrel, the tubes simultaneously collapse to direct components through outlet ports and into a static mixer where the components are mixed to a homogeneous mass. Each tube includes a relatively rigid front and rear end piece and the end pieces are coupled together by pin elements. In FIG. 7, half moon shaped and pieces 42 are shown.

Gentile, U.S. Pat. No. 5,392,947 discloses a dental mouthwash product which includes a dispensing container having at least two discrete compartments. A closure mechanism is sealingly attached to an upper end of the dispensing container. The two compartments can either be formed of two entirely separate compartments which are held together by the closure or can be formed by a dividing wall in the container.

Pardo, U.S. Pat. No. 4,196,808 discloses sequential closure interlock devices for container packages having multiple product compartments provided with parallel neck finishes lying generally in a single plane. The unitized package may further comprise means such as a shrink wrap joining the containers into a unified package. More than two compartments and/or bottles or containers may be utilized and other means than the shrink wrap bands may be utilized to join the bottle or containers into the unified package. For example, label panels spanning the joint between the bottles or containers and bonded to each of the bottles or containers may be used, as may direct bonding of the bottles or containers to each other. Other types of bands or outer packaging or wraps may also be similarly utilized.

Buske, U.S. Pat. No. 3,933,268 discloses a container for packaging liquids having the form of preferably a right prism with two polygonal bases and being adapted to be placed with at least one of its basal and lateral faces against corresponding faces of similarly formed containers to form a group of containers. At least one of the basal and lateral faces is provides with means for engaging a corresponding face of a similar container when placed against the corresponding face to counteract slipping between the engaging faces.

Poston et al., U.S. Pat. No. 3,225,951 comprises a washer reservoir construction which includes integral formations for supporting a bottle of concentrated washer solvent, thus eliminating the need for a separate fastening clip. The washer reservoirs and solvent containers may have complementary formations of the tongue and groove type.

Abfier et al., U.S. Pat. No. DES 353,326 discloses the design for what appears to be a dual container.

Jennison, U.S. Pat. No. 4,165,812 discloses a multi-container package wherein the containers are detachably connected by projections and recesses.

Mednis, U.S. Pat. No. 4,573,595 discloses a multi purpose container unit whose hollow body neck and shoulder sections are proportioned and constructed in a manner that allows interfacing and mating with an identical or mirror image unit of like size, volume or exterior proportions. Mednis, U.S. Pat. No. 4,640,423 discloses containers mated together to form a polyhedron.

Douglas et al., U.S. Pat. No. 5,158,191 discloses a dual container having two bottles which are releasably interlocked in side-by-side relation by a mortise and tenon. A single cap covers both bottles, but the cap has a separate outlet for each bottle, which may be opened independently of each other.

Douglas et al., U.S. Pat. No. 5,316,159 discloses a dual bottle container wherein two bottles are releasably interlocked together in side-by-side relation by a plateau on one of the bottles which engages a depression on the other bottle.

Reil et al., U.S. Pat. No. 5,158,209 discloses a package for flowable media comprised of two tube-shaped parts each forming an entire side wall, two oppositely disposed and adjacent half side wall parts, a half bottom part and a half upper wall part with a half pourer device. These are in each case sealed and connected to each other individually by a synthetic plastic film.

There remains a need for an improved dual container for dispensing separately stored components in a manner so that they can emerge proximate each other and mix into a single product stream.

SUMMARY OF THE INVENTION

The present invention is directed to a dual chamber package which is comprised of interlocking bottles suitable for keeping ingredients separate prior to dispensing, but permitting the ingredients to be dispensed proximate each other through product exit finishes leading to adjacent product exit openings. Preferably, the bottle of the invention includes two identical chambers which are designed and molded in such a way that when placed back to back they interlock, forming the single dual chamber package. The interlocking design of the invention permits assembly at the molder and delivery of a single package for filling. The closure preferably includes a shell surrounding the product exit cylinders and a flip top cap associated with the shell.

Each chamber includes a front aspect and a rear aspect, the front and rear aspects preferably having interiors which are in communication with each other. The front aspect includes a bottom surface and the rear aspect includes a bottom surface and a top surface. The rear aspect bottom surface forms half of the base of the dual bottle. The rear aspect top surface is complimentary to the bottom surface of the front aspect of the other chamber. Due in part to the complimentary surfaces, the two chambers are permitted to interlock.

For a more complete understanding of the above and other features and advantages of the invention, reference should be made to the following detailed description of the preferred embodiments and to the accompanying drawings.

DETAILED DESCRIPTION OF THE INVENTION

Figure 1:
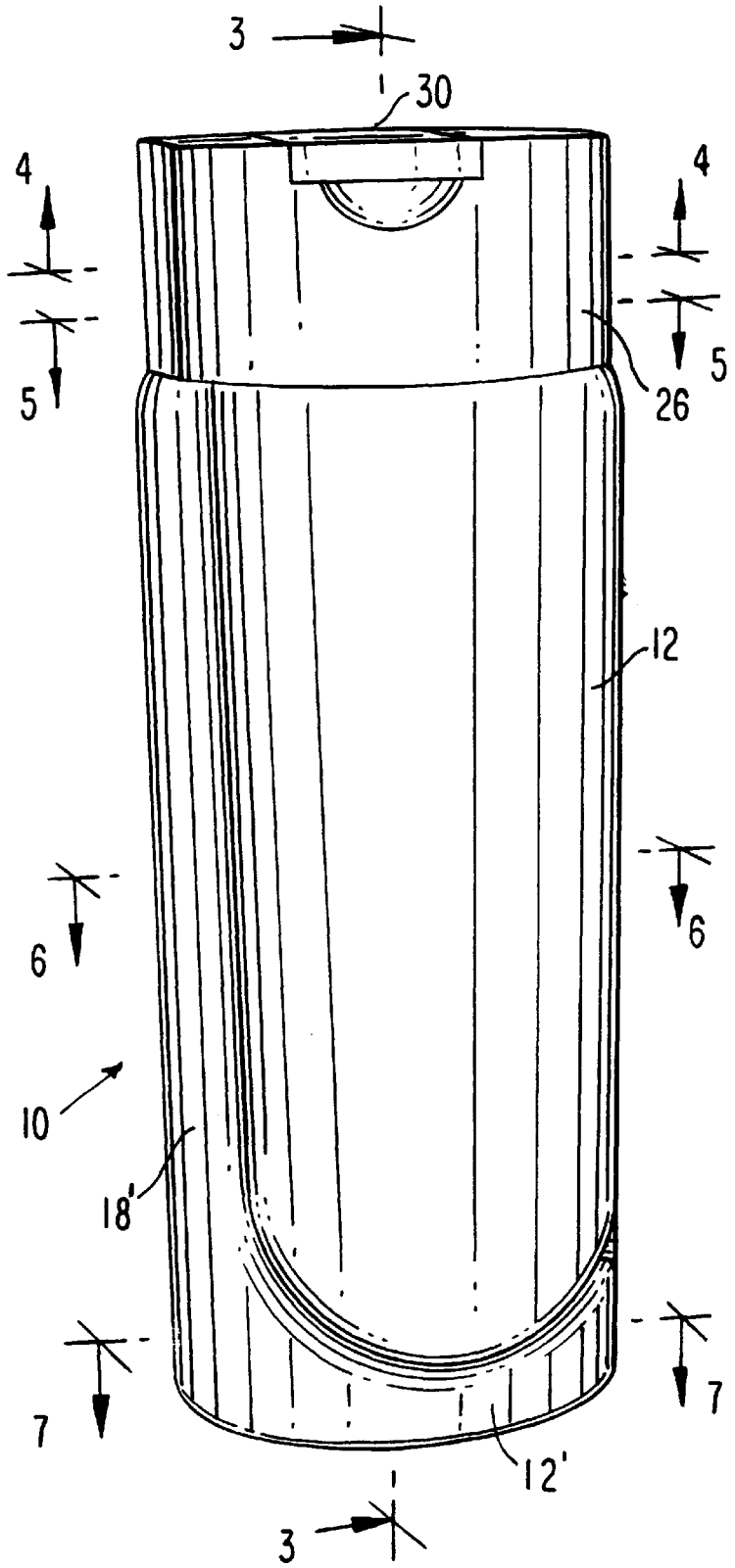
FIG. 1 is a front perspective view of a dual bottle of the invention.

As seen in FIG. 1, dual bottle 10 includes chambers 12 and 12', which are preferably identical, as illustrated. Chamber 12 includes front aspect 14 (FIG. 2) and rear aspect 16. Preferably both front aspect 14 and rear aspect 16 are hollow and their interiors are in communication with each other so that product can flow from one to the other. Even if front aspect 14 and 16 are not in communication with each other, they are preferably interconnected.

Figure 2:
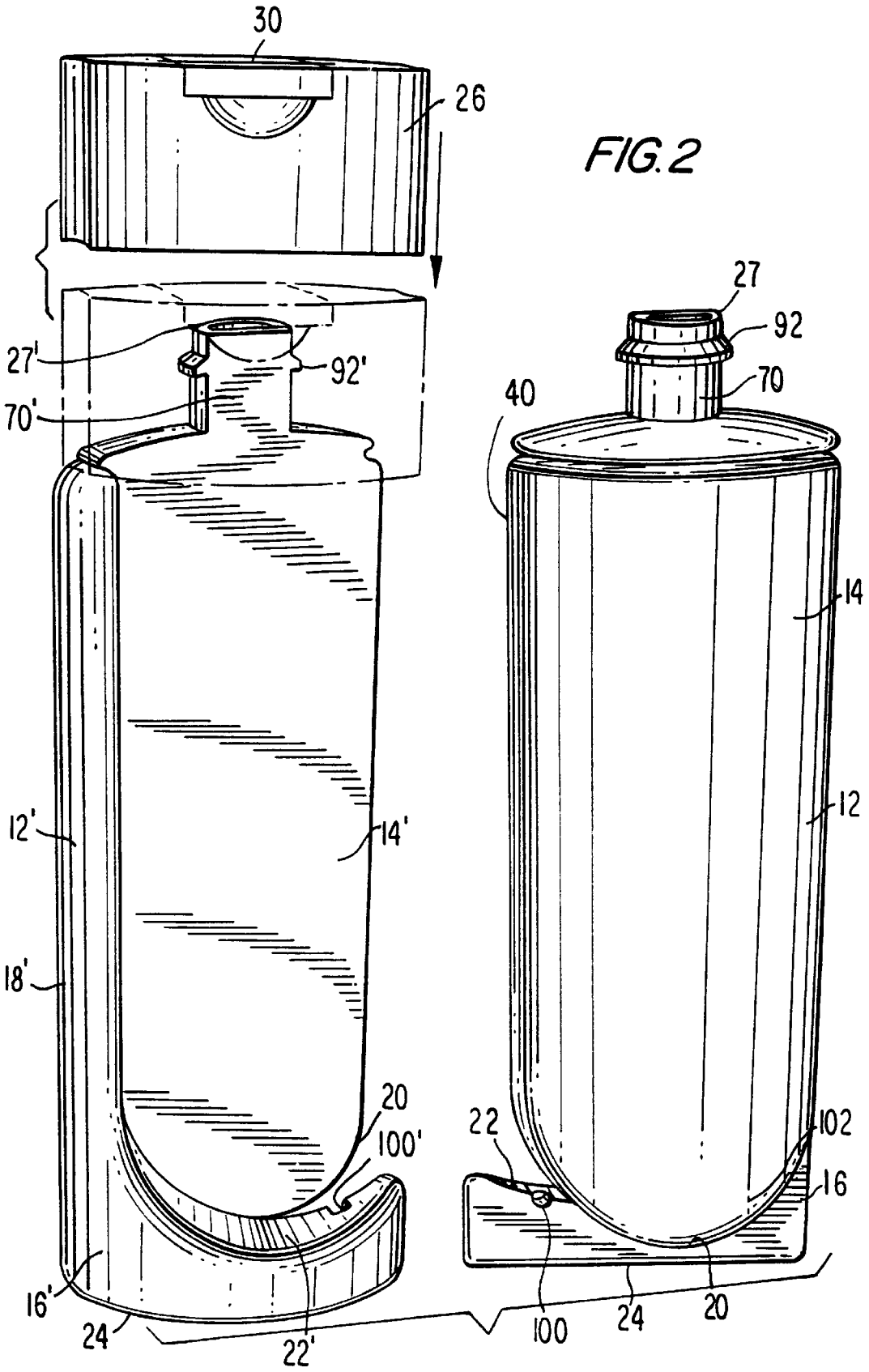
FIG. 2 is a perspective view of the dual bottle showing the chambers separated and showing the manner of insertion of the common closure.
Figure 6:
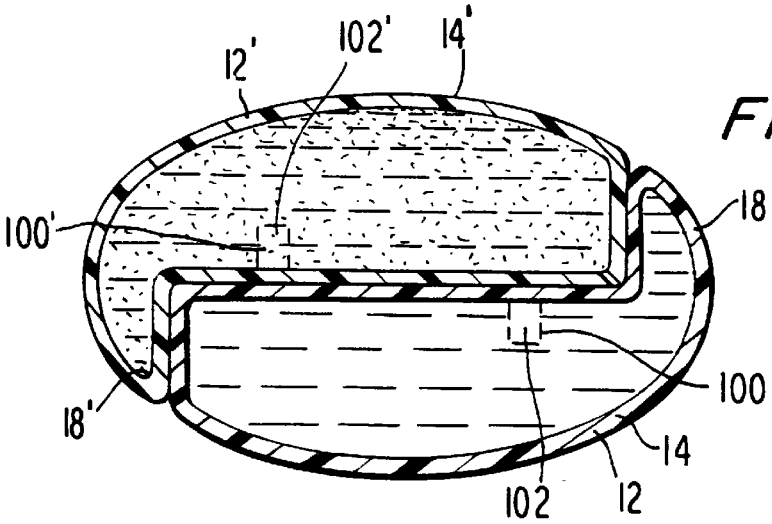
FIG. 6 is a cross section along the lines 6—6 of FIG. 1.
Figure 7:
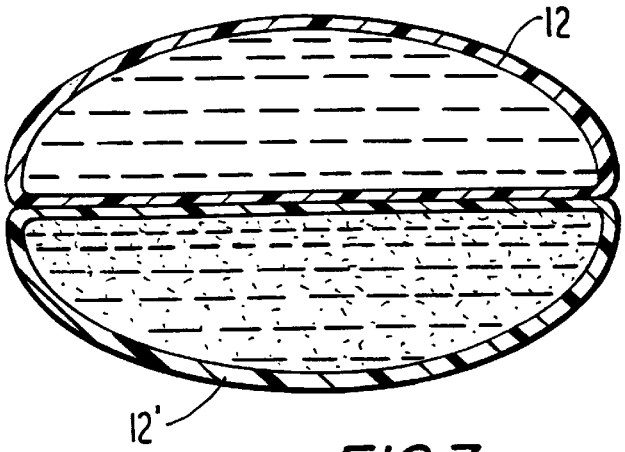
FIG. 7 is a cross section along the lines 7—7 of FIG. 1.

Rear aspect 16 also includes a side tongue-shaped section 18 as best seen in FIG. 6 and, with respect to chamber 12', as seen in FIGS. 1 and 2 (18'). Front aspect 14 includes a bottom surface 20 which is rounded in the embodiment shown. Rear aspect 16 includes a top surface 22 which is complementary at least in part to bottom surface 20 of front aspect 14. Rear aspect 16 also includes bottom surface 24 which serves as a base for the respective chamber, and in part also for the dual bottle. Chambers 12, 12' include at their tops, separate product exit finishes 70, 70' leading to product exit apertures 27, 27'.

Common closure 26 comprises outer shell walls 74, cap 30 associated with the outer shell walls and product exit apertures 76, 76' in platform 78, 78'. Cap 30 is hingedly attached to the shell by plastic strips 32. Inner cylinder 90 of closure 26 includes inwardly directed cylindrical bead 34 which can be snapped fit below outwardly extending beads 92, 92' on finishes 70, 70'.

Product exit apertures 76, 76' are oriented to dispense product in an opposite direction to rear aspect 16 bottom surfaces 24, 24', the bottle bases.

Chambers 12 and 12' are combined into dual bottle 10 by snapping the chambers together back to back. As best seen in FIG. 2, upper surface 22' of rear aspect 16' is complementary to lower surface 20 of front aspect 14. Likewise, lower surface 20' of front aspect 14' of chamber 12' is accommodated by the upper surface 22 of rear aspect 16 of chamber 12. Also, side portion 18' of rear aspect 16' is shaped and dimensioned to accommodate side 40 of front aspect 14 of chamber 12. Chambers 12 and 12' may be interlocked completely independently of common closure 26, although closure 26 may also help stabilize the dual bottle. If desired, projections 102 (phantom FIG. 2), 102' may be present on rear aspects 16, 16' to mate with slots 100, 100' to assist in locking the chambers together.

As can be seen in phantom in FIG. 2, common closure 26 can be inserted on the interlocked chambers 12, 12' from above.

Product exit finishes 70, 70' extend through channel 50 within outer shell walls 74 of closure 26. Within channel 50, the two components of the product are separately conveyed and do not mix prior to egress through product exit openings 76, 76' in common closure 26. Product exit finishes 70, 70' are each half-moon shaped, comprising a straight portion the ends of which are connected by an arc 108, 108'. When the chambers are snapped together the outer surfaces of the straight portions are disposed contiguous to each other and the arcs of each half together form the profile of a full cylinder.

Figure 3:
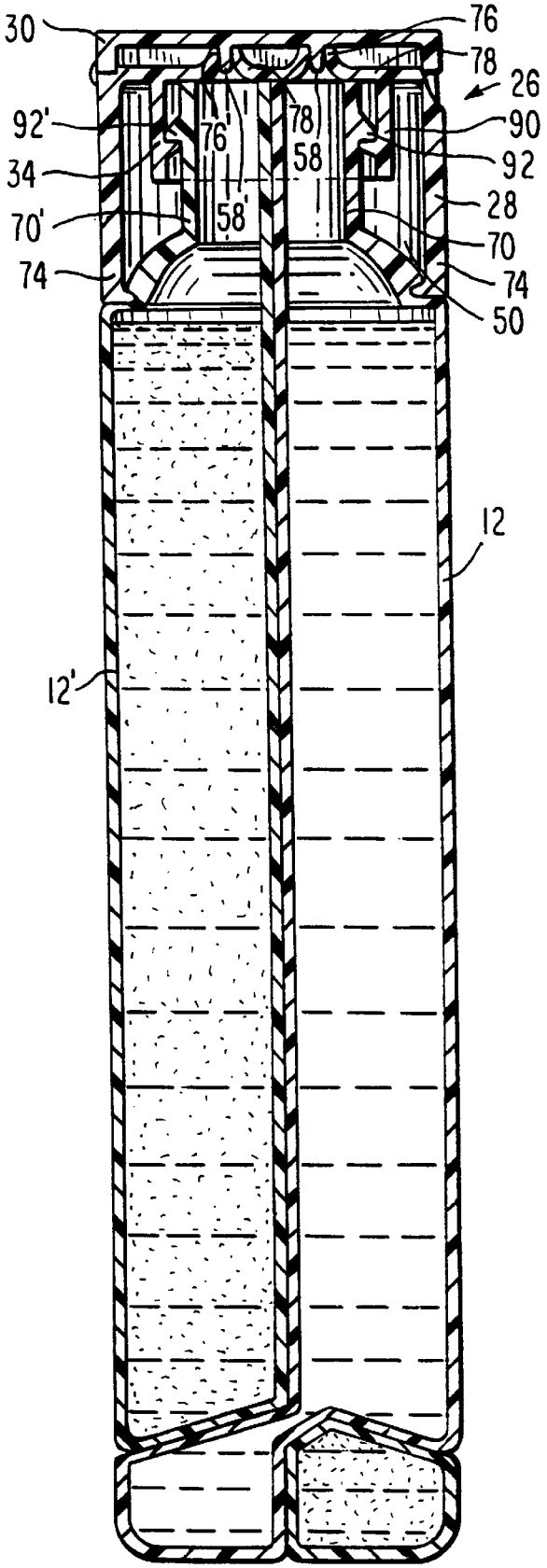
FIG. 3 is a cross section according to the lines 3—3 of FIG. 1.
Figure 4:
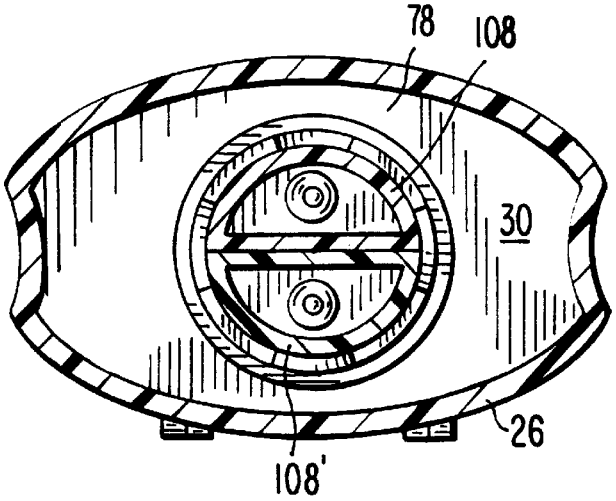
FIG. 4 is a cross section along the lines 4—4 of FIG. 1.
Figure 5:
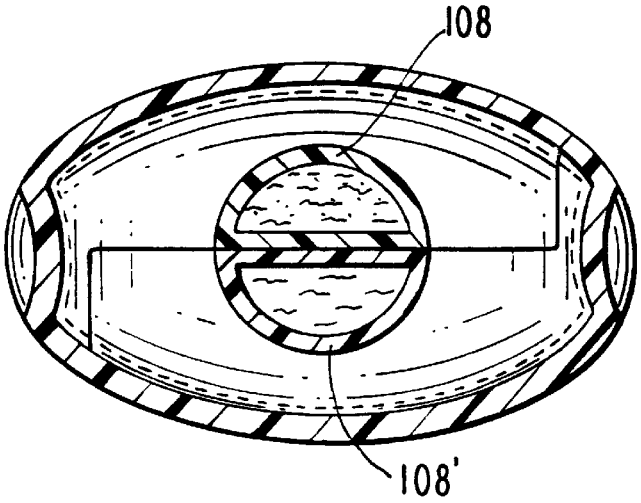
FIG. 5 is a cross section along the lines 5—5 of FIG. 1.
Figure 8:
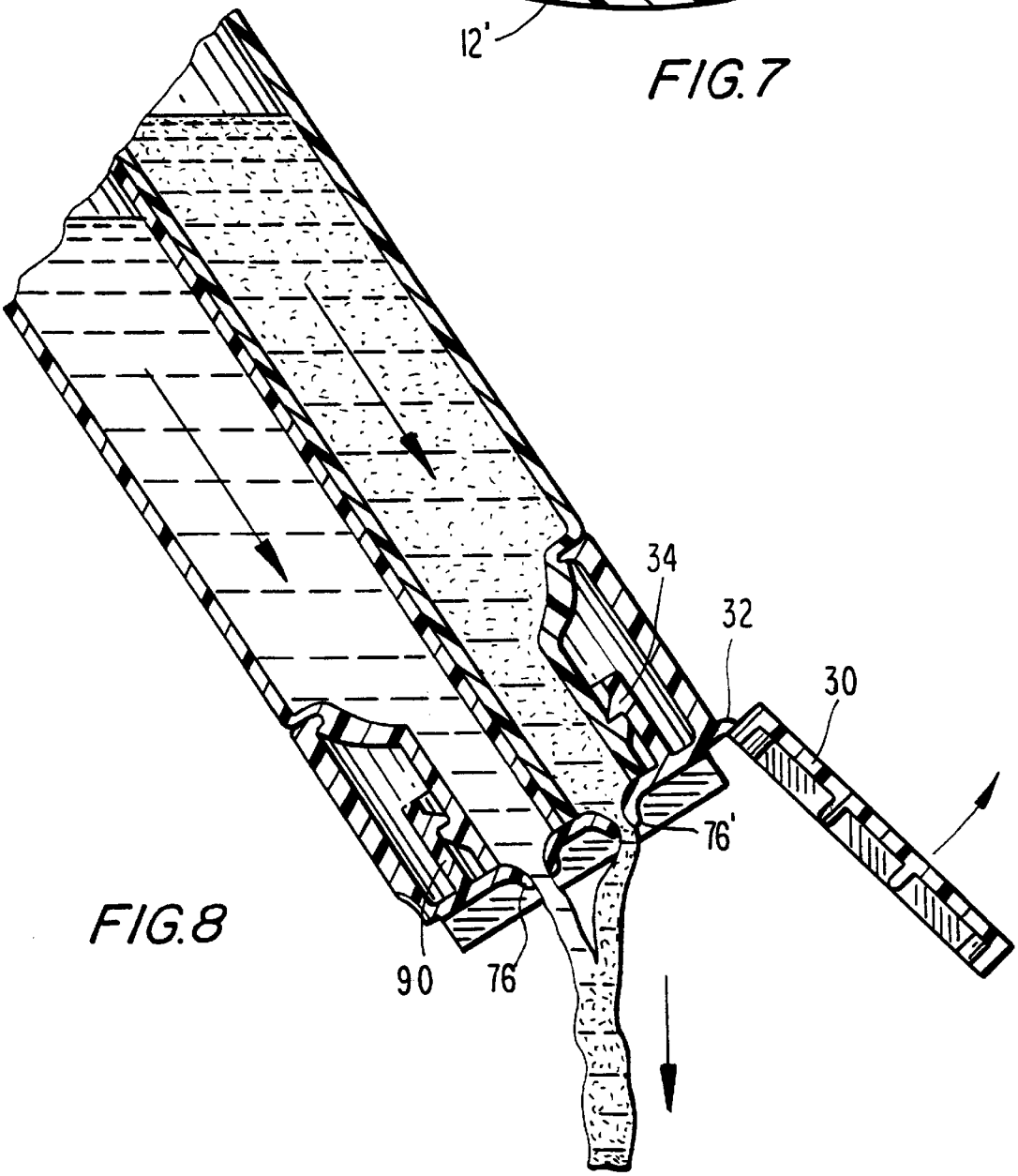
FIG. 8 is a cross section of the bottle of the invention with the cap in the open position and the bottle inverted to permit product to pour from the product exit opening.

Cap 30 may be disposed in the open position seen in FIG. 8 or in the closed position seen in FIG. 3. In the closed position, depending plugs 58, 58' of cap 30 extends into and assists in closing product exit opening 52.

As best visualized from FIG. 6, the periphery of the dual bottle formed by the two chambers forms a mirror image along (1) a mirror extending perpendicular to the paper along the longitudinal axis of the section as well as (2) along the plane perpendicular thereto and also perpendicular to the paper (ignoring the slight discontinuities in the periphery where the two chambers meet).

The chambers of the dual bottle are preferably thermoplastics such as polyethylene and are preferably made by blow molding.

It will be appreciated that the invention provides a dual package which admits of dispensing from adjacent openings yet which comprises two chambers which may be identical, thus simplifying manufacture.

It should be understood, of course, that specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A bottle comprising a) at least two separable chambers; and b) a common closure for said at least two chambers;

c) each of said chambers including a front aspect and an interconnected rear aspect, said front aspect of each said chamber comprising a front aspect bottom surface, said rear aspect of each such chamber having a rear aspect bottom surface and a rear aspect top surface, said rear aspect bottom surface of each said chamber forming a bottle base, and said rear aspect top surface of each said chamber being complementary to the bottom surface of the front aspect of each said other chamber;

d) said chambers being releasably interlockable independent of said common closure to form a unitary bottle wherein the front aspects of said chambers are disposed on opposite sides of said bottle.

2. The bottle according to claim 1 wherein said chambers are identical.

3. The bottle according to claim 1 wherein said common closure further locks together said chambers.

4. The bottle according to claim 1 wherein said common closure includes at least one product exit openings and a cap hingedly attached to said closure pivotable between a closed position blocking the product exit openings and an open position.

5. The bottle according to claim 4 wherein said cap includes a depending plug which fits within said common product exit openings when said cap is in the closed position.

6. The bottle according to claim 1 wherein for each chamber said front aspect interior is in fluid communication with said rear aspect interior.

7. The bottle according to claim 1 wherein said bottle includes two side walls and each of said two chambers forms one of said side walls.

8. A chamber for a dual bottle comprising a front aspect and a rear aspect, said front aspect being interconnected with said rear aspect, said front aspect comprising a front aspect bottom surface at an end thereof, said rear aspect having a rear aspect bottom surface and a rear aspect top surface, said rear aspect bottom surface forming a bottle base, and said rear aspect top surface having a shape complementary to the bottom surface of the front aspect of said chamber, so that said chamber is capable of interlocking with another said chamber to form a dual bottle wherein said front aspects are disposed on opposite sides of said bottle said front aspect comprising a product exit aperture at an opposite end thereof, said aperture being oriented to dispense product in an opposite direction to said bottle base.

9. The chamber according to claim 8 wherein said front aspect interior is in communication with the interior of the rear aspect of the said chamber.

10. The chamber according to claim 8, said chamber having a product exit aperture formed such that said interlocked chambers have product exit apertures adjacent each other.

* * * * *